US011795641B2

(12) United States Patent
Michel

(10) Patent No.: US 11,795,641 B2
(45) Date of Patent: Oct. 24, 2023

(54) SWEEPING BLADE AND SWEEPING BLADE ASSEMBLY FOR A VEHICLE

(71) Applicant: Usinage PRO24 Inc., Val-des-Sources (CA)

(72) Inventor: Hugo Michel, St-Remi-de-Tingwick (CA)

(73) Assignee: Gestion Pihm Inc.

( * ) Notice: Subject to any disclaimer, the term of this patent is extended or adjusted under 35 U.S.C. 154(b) by 257 days.

(21) Appl. No.: 17/210,700

(22) Filed: Mar. 24, 2021

(65) Prior Publication Data

US 2022/0307211 A1 Sep. 29, 2022

(51) Int. Cl.
*E01H 5/06* (2006.01)
*E01H 1/10* (2006.01)

(52) U.S. Cl.
CPC ..... *E01H 5/061* (2013.01); *E01H 1/105* (2013.01)

(58) Field of Classification Search
CPC ..... E01H 5/061; E01H 1/105; E01H 5/06; E01H 5/062; E01H 5/063; E01H 5/065; E01H 5/066
See application file for complete search history.

(56) References Cited

U.S. PATENT DOCUMENTS

| | | | | |
|---|---|---|---|---|
| 1,383,409 | A | | 7/1921 | Liddell |
| 2,055,291 | A | | 9/1936 | Henry |
| 2,116,351 | A | | 5/1938 | Jones et al. |
| 2,762,139 | A | | 9/1956 | Launder |
| 2,884,082 | A | | 4/1959 | Osterhaus |
| 3,084,750 | A | | 4/1963 | Linden |
| 3,160,967 | A | | 12/1964 | Nichols |
| 3,400,475 | A | | 9/1968 | Peitl |
| 3,454,108 | A | | 7/1969 | Skrukrud |
| 3,455,041 | A | | 7/1969 | Roberts |
| 3,465,456 | A | | 9/1969 | Meyer |
| 3,477,149 | A | * | 11/1969 | Wagner ..... E01H 5/061 172/701.3 |
| 3,514,830 | A | | 6/1970 | Takakita et al. |
| 3,736,664 | A | | 6/1973 | Black et al. |
| 3,772,803 | A | | 11/1973 | Cote |
| 3,864,853 | A | | 2/1975 | Klett et al. |
| 4,068,725 | A | | 1/1978 | Watson |
| 4,159,584 | A | | 7/1979 | Niemela |

(Continued)

FOREIGN PATENT DOCUMENTS

| | | |
|---|---|---|
| CA | 1233983 | 3/1988 |
| CA | 2110949 | 6/1995 |

(Continued)

OTHER PUBLICATIONS

Communication Pursuant to Article 94(3) EPC; dated Oct. 21, 2020.

*Primary Examiner* — Adam J Behrens
*Assistant Examiner* — Blake E Scoville
(74) *Attorney, Agent, or Firm* — Bradley J. Thorson; DeWitt LLP

(57) ABSTRACT

There is provided a sweeping blade device comprising: a blade main portion including a rigid sweeping blade having convexly curved and opposed lateral edges. The sweeping blade device can be mounted to a blade support, which in turn is securable to a vehicle to form a sweeping blade assembly configured to be attached to a plow blade of the vehicle for sweeping debris on a ground surface.

16 Claims, 14 Drawing Sheets

(56) References Cited

U.S. PATENT DOCUMENTS

| | | | | |
|---|---|---|---|---|
| 4,166,640 | A | 9/1979 | Van Denberg | |
| 4,288,932 | A | 9/1981 | Kuper | |
| 4,305,272 | A | 12/1981 | Johnson | |
| 4,307,523 | A | 12/1981 | Reissinger et al. | |
| 4,570,366 | A | 2/1986 | Yost | |
| 4,590,694 | A * | 5/1986 | Block | E01H 5/061 37/460 |
| 4,635,387 | A | 1/1987 | Haring | |
| 4,669,205 | A | 6/1987 | Smathers | |
| 4,671,363 | A | 6/1987 | Bolinger | |
| 4,711,187 | A | 12/1987 | Schultz | |
| 4,770,253 | A | 9/1988 | Hallissy et al. | |
| 4,794,710 | A | 1/1989 | Haring | |
| 4,944,104 | A | 7/1990 | Kowalczyk | |
| 5,025,577 | A | 6/1991 | Verseef | |
| 5,032,342 | A | 7/1991 | Drabing | |
| 5,140,763 | A | 8/1992 | Nichols, IV | |
| 5,191,729 | A | 3/1993 | Verseef | |
| 5,309,653 | A | 5/1994 | Pease et al. | |
| 5,437,113 | A | 8/1995 | Jones | |
| 5,456,323 | A | 10/1995 | Hill | |
| 5,471,770 | A | 12/1995 | Ferreira | |
| 5,477,600 | A | 12/1995 | Houle et al. | |
| 5,697,172 | A | 12/1997 | Verseef | |
| 5,715,613 | A | 2/1998 | Ebert | |
| 5,743,032 | A | 4/1998 | Vauhkonen | |
| 5,746,017 | A * | 5/1998 | Marvik | E01H 5/061 37/446 |
| 5,778,572 | A | 7/1998 | Lukavich et al. | |
| 5,813,474 | A | 9/1998 | Manway | |
| 5,819,443 | A | 10/1998 | Winter | |
| 5,829,174 | A | 11/1998 | Hadler et al. | |
| 5,881,480 | A | 3/1999 | Fall | |
| 6,094,845 | A | 8/2000 | Lela | |
| 6,145,858 | A | 11/2000 | Foulquier | |
| 6,354,024 | B1 | 3/2002 | Kost et al. | |
| 6,854,527 | B2 | 2/2005 | Manway et al. | |
| 6,922,924 | B2 | 8/2005 | Jones et al. | |
| 7,107,709 | B2 | 9/2006 | Hamel | |
| 7,467,485 | B2 | 12/2008 | Lachance et al. | |
| 7,631,441 | B2 | 12/2009 | Hunt | |
| 7,631,702 | B2 | 12/2009 | Hansen | |
| 7,665,234 | B2 | 2/2010 | Diehl et al. | |
| 8,191,287 | B2 | 6/2012 | Winter et al. | |
| 8,844,173 | B2 * | 9/2014 | Winter | E01H 5/061 37/266 |
| 8,984,778 | B2 * | 3/2015 | Fox | E01H 5/062 37/266 |
| 9,121,151 | B2 | 9/2015 | Bergeron et al. | |
| 2001/0005949 | A1 | 7/2001 | Amano et al. | |
| 2002/0078604 | A1 | 6/2002 | Kost et al. | |
| 2003/0066210 | A1 | 4/2003 | Hollinrake et al. | |
| 2003/0182824 | A1 | 10/2003 | Coffin et al. | |
| 2003/0188463 | A1 | 10/2003 | Manway et al. | |
| 2003/0221338 | A1 | 12/2003 | Verseef | |
| 2004/0177534 | A1 | 9/2004 | Jones et al. | |
| 2006/0070264 | A1 | 4/2006 | Lachance et al. | |
| 2007/0256334 | A1 | 11/2007 | Schmeichel | |
| 2007/0271828 | A1 | 11/2007 | Mishra et al. | |
| 2009/0223090 | A1 | 9/2009 | Hunt | |
| 2009/0307934 | A1 | 9/2009 | Hunt | |
| 2013/0174452 | A1 * | 7/2013 | Diehl | E01H 5/063 37/233 |
| 2013/0185962 | A1 | 7/2013 | Reeves | |
| 2013/0239352 | A1 * | 9/2013 | Bergeron | E01H 5/061 15/245 |
| 2016/0354810 | A1 * | 12/2016 | Zwerner | E01H 5/062 |
| 2019/0017237 | A1 * | 1/2019 | Michel | E01H 5/062 |
| 2019/0136474 | A1 * | 5/2019 | Martin | E01H 5/062 |
| 2021/0156099 | A1 * | 5/2021 | Vallieres | E01H 5/12 |

FOREIGN PATENT DOCUMENTS

| | | |
|---|---|---|
| CA | 2401809 | 3/2003 |
| CA | 2423830 | 7/2003 |
| CA | 2479905 | 3/2006 |
| CA | 2542919 | 10/2007 |
| CA | 2712715 | 2/2012 |
| CA | 2856940 | 6/2012 |
| DE | 881200 | 6/1953 |
| DE | 7141159 | 7/1972 |
| DE | 2164525 | 6/1973 |
| DE | 2437723 | 12/1986 |
| DE | 4441654 | 6/1995 |
| DE | 10261421 | 7/2004 |
| DE | 102005040705 | 3/2007 |
| EP | 1234915 | 8/2002 |
| EP | 2495368 | 9/2012 |
| FR | 1243526 | 9/1960 |
| FR | 1255480 | 1/1961 |
| FR | 2539438 | 7/1984 |
| GB | 2502273 | 11/2013 |
| JP | H07034426 | 2/1995 |
| SE | 454279 | 4/1988 |
| WO | 199528526 | 10/1995 |
| WO | 2011123956 | 10/2011 |
| WO | 2012070943 | 5/2012 |

* cited by examiner

SWEEPING BLADE AND SWEEPING BLADE ASSEMBLY FOR A VEHICLE

TECHNICAL FIELD

The present disclosure relates to snowplowing vehicles. More particularly, the present disclosure relates to sweeping blades and to sweeping blade assemblies for vehicles, such as snowplowing vehicles.

BACKGROUND

Snowplowing vehicles are well known in countries that experience significant snowfall and severe cold. Such vehicles include a sweeping blade which travels over the surface of a substrate such as a road, airport, runway, parking lot or the like for removing snow, ice, snowpacks, icepacks, debris such as gravel or rocks, or the like.

The typical challenge of these vehicles is the presence of uneven surfaces and obstacles on the road especially those of a protruding nature e.g. bumps, which cause uneven wear and premature damage to the blade and/or the entire assembly accompanied by an uneven cleaning of the areas surrounding the protruding obstacle.

Sweeping blade assemblies including displaceable sweeping blades have been developed. More particularly, some sweeping blade assemblies have been conceived wherein the sweeping blades can move upward to clear an obstacle on the road surface. Depending on the location of the obstacle hit by the sweeping blade with respect to its scraping edge, the sweeping blade will experience a linear displacement or an angular displacement. When experiencing a linear displacement, the sweeping blade will translate along a plane corresponding substantially to an attack angle of the sweeping blade assembly. When experiencing an angular displacement, the sweeping blade will rotate to one side (or tilt).

Because the sweeping blades are configured in an adjacent configuration in a sweeping blade assembly, the allowed angular movement is typically limited by the position of adjacent blades.

Therefore, there remains a need for improved sweeping blade assemblies and sweeping blades which, by virtue of their designs and components, would be able to overcome or at least minimize some of the above-discussed concerns.

SUMMARY

It is an object of the present disclosure to provide sweeping blades, sweeping blade devices and sweeping blade assemblies for vehicles adapted for sweeping a ground surface that overcome or mitigate one or more disadvantages of known sweeping blades, sweeping blade devices and sweeping blade assemblies, or at least provide useful alternatives.

In accordance with a general aspect of the invention, there is provided a sweeping blade assembly configured to be attached to a plow blade of a vehicle for sweeping debris on a ground surface. The sweeping blade assembly comprises: a blade support securable to the vehicle; and a sweeping blade device comprising: a blade main portion mounted to the blade support and comprising a rigid sweeping blade having convexly curved and opposed lateral edges and a lower scraping edge.

In an embodiment, the blade main portion further comprises a resilient material layer covering at least partially the rigid sweeping blade including the convexly curved lateral edges of the rigid sweeping blade, the blade main portion having convexly and curved lateral edges formed by the resilient material layer covering the convexly curved lateral edges of the rigid sweeping blade.

In an embodiment, the blade main portion further comprises a resilient material layer covering at least partially the rigid sweeping blade including the convexly curved lateral edges of the rigid sweeping blade, the blade main portion having substantially straight lateral edges formed by the resilient material layer covering the convexly curved lateral edges of the rigid sweeping blade, the substantially straight lateral edges of the blade main portion extending substantially parallel to one another.

In an embodiment, the blade main portion comprises an upper edge, spaced-apart from the lower scraping edge and extending substantially parallel thereto. The sweeping blade device can further comprise blade inserts contained in the rigid sweeping blade at the lower scraping edge and the upper edge of the rigid sweeping blade. The blade inserts can be exposed outwardly at the lower scraping edge. In an embodiment, the convexly curved lateral edges of the rigid sweeping blade can have a radius of curvature ranging between about 70 inches and about 90 inches.

In an embodiment, the blade support has at least two of the sweeping blade device mounted thereto with a gap defined between adjacent ones of the sweeping blade devices, the gap ranging between about 0.2 inch and about 0.3 inch at the lower scraping edge of the blade main portion.

In accordance with another general aspect of the invention, there is provided a vehicle comprising a sweeping blade assembly as described above.

In accordance with still another general aspect of the invention, there is provided a sweeping blade device comprising: a blade main portion including a rigid sweeping blade having convexly curved and opposed lateral edges.

In an embodiment, the blade main portion further comprises a resilient material layer covering at least partially the rigid sweeping blade including the convexly curved lateral edges of the rigid sweeping blade, the blade main portion having convexly curved lateral edges formed by the resilient material layer covering the convexly curved lateral edges of the rigid sweeping blade.

In an embodiment, the blade main portion further comprises a resilient material layer covering at least partially the rigid sweeping blade including the convexly curved lateral edges of the rigid sweeping blade, the blade main portion having substantially straight lateral edges formed by the resilient material layer covering the convexly curved lateral edges of the rigid sweeping blade, the substantially straight lateral edges of the blade main portion extending substantially parallel to one another.

In an embodiment, the blade main portion comprises a lower scraping edge and an upper edge, spaced-apart from the lower scraping edge and extending substantially parallel thereto. The sweeping blade device can further comprise blade inserts contained in the rigid sweeping blade at the lower scraping edge and the upper edge of the rigid sweeping blade. The blade inserts can be exposed outwardly at the lower scraping edge.

In an embodiment, the convexly curved lateral edges of the rigid sweeping blade have a radius of curvature ranging between about 70 inches and about 90 inches.

In an embodiment, the blade support can have at least two of the sweeping blade device mounted thereto with a gap defined between adjacent ones of the sweeping blade devices, the gap ranging between about 0.2 inch and about 0.3 inch at the lower scraping edge of the blade main portion.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

Figure 1:
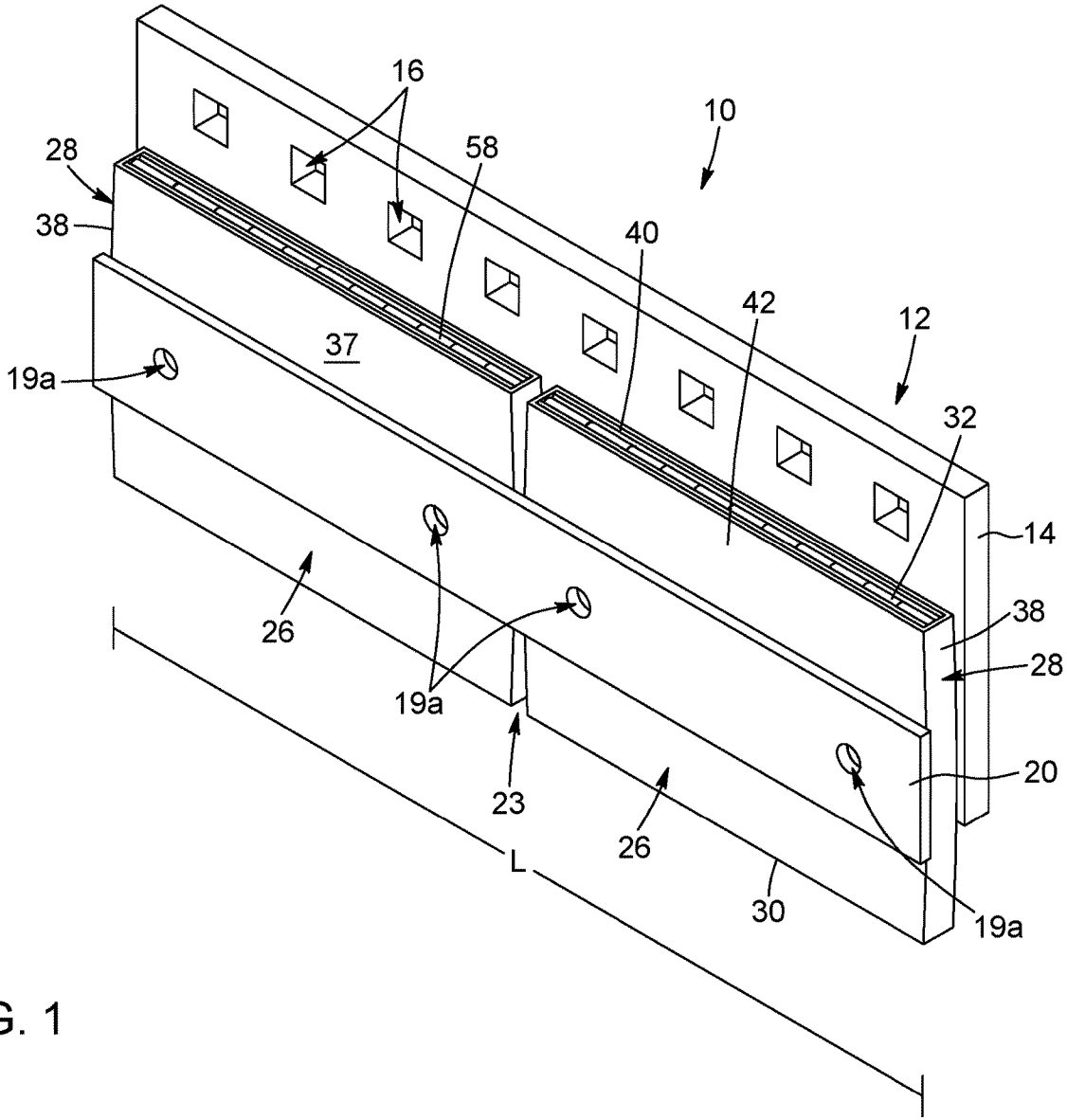
FIG. 1 is a top and front perspective view of a sweeping blade assembly in accordance with a non-limitative embodiment, the sweeping blade assembly being configured to be attached to a blade support of a vehicle for sweeping a ground surface.

In the following description, the same numerical references refer to similar elements. Furthermore, for the sake of simplicity and clarity, namely so as to not unduly burden the figures with several reference numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures or described in the present disclosure are embodiments only, given solely for exemplification purposes.

Furthermore, in the context of the present description, it will be considered that all elongated objects will have an implicit "longitudinal axis" or "centerline", such as the longitudinal axis of a shaft for example, or the centerline of a biasing device such as a coiled spring, for example, and that expressions such as "connected" and "connectable", "secured" and "securable", "engaged" and "engageable", "installed" and "installable" or "mounted" and "mountable", may be interchangeable, in that the present sweeping blade assembly or sweeping blade device also relates to kits with corresponding components for assembling a resulting fully-assembled and fully-operational sweeping blade assembly or sweeping blade device.

It is to be understood that the phraseology and terminology employed herein is not to be construed as limiting and are for descriptive purpose only. The principles and uses of the teachings of the present invention may be better understood with reference to the accompanying description, figures and examples. It is to be understood that the details set forth herein do not construe a limitation to an application of the invention. Furthermore, it is to be understood that the invention can be carried out or practiced in various ways and that the invention can be implemented in embodiments other than the ones outlined in the description above.

Moreover, components of the sweeping blade assembly, sweeping blade device, bushing assembly and/or steps of the method(s) described herein could be modified, simplified, altered, omitted and/or interchanged, without departing from the scope of the present disclosure, depending on the particular applications which the present sweeping blade assembly or sweeping blade device is intended for, and the desired end results, as briefly exemplified herein and as also apparent to a person skilled in the art.

In addition, although the embodiments as illustrated in the accompanying drawings comprise various components, and although the embodiments of the present sweeping blade assembly or sweeping blade device and corresponding portion(s)/part(s)/component(s) as shown consist of certain geometrical configurations, as explained and illustrated herein, not all of these components and geometries are essential and thus should not be taken in their restrictive sense, i.e. should not be taken so as to limit the scope of the present disclosure. It is to be understood, as also apparent to a person skilled in the art, that other suitable components and cooperation thereinbetween, as well as other suitable geometrical configurations may be used for the present sweeping blade assembly, sweeping blade device, bushing assembly and corresponding portion(s)/part(s)/component(s) according to the present sweeping blade assembly, as will be briefly explained herein and as can be easily inferred herefrom by a person skilled in the art, without departing from the scope of the present disclosure.

To provide a more concise description, some of the quantitative and qualitative expressions given herein may be qualified with the terms "about" and "substantially". It is understood that whether the terms "about" and "substantially" are used explicitly or not, every quantity or qualification given herein is meant to refer to an actual given value or qualification, and it is also meant to refer to the approximation to such given value or qualification that would reasonably be inferred based on the ordinary skill in the art, including approximations due to the experimental and/or measurement conditions for such given value.

The present disclosure describes a sweeping blade assembly that is configured to be attached to a vehicle and, more particularly, to a plow blade of the vehicle, in a lower portion thereof, for sweeping a ground surface. It is appreciated that a plurality of sweeping blade assemblies can be mounted to the plow blade of the vehicle, in an adjacent configuration, to cover a length thereof. Each one of the sweeping blade assemblies can include a plurality of sweeping blade devices. The sweeping blades devices can be configured in an adjacent configuration to enhance removal of snow, ice and/or other debris that are provided on the ground surface and/or to maintain the resistance of the whole sweeping blade assembly, and which, by virtue of its design and components, overcomes or at least minimizes some of the above-discussed drawbacks.

Indeed, in accordance with a non-limitative embodiment, the sweeping blade assembly includes a blade support securable to the plow blade of the vehicle and one or more sweeping blade devices, securable to the blade support to be engaged with the vehicle. In an embodiment, the sweeping blade assembly includes a plurality of sweeping blade devices mounted in an adjacent configuration. Each blade support supports a plurality of the sweeping blade devices and the vehicle and its plow blade can have a plurality of blade supports also mounted in an adjacent configuration.

The sweeping blade assembly can be mounted to the plow of a vehicle, either a personal or a commercial vehicle, which can be a pickup truck, a tractor, an ATV, a UTV, a loader/backhoe, a skid-steer, a larger vehicle such as a spreader truck, a dump body truck, and the like. It can be used either as light or heavy duty snowplow blades.

Figure 2:
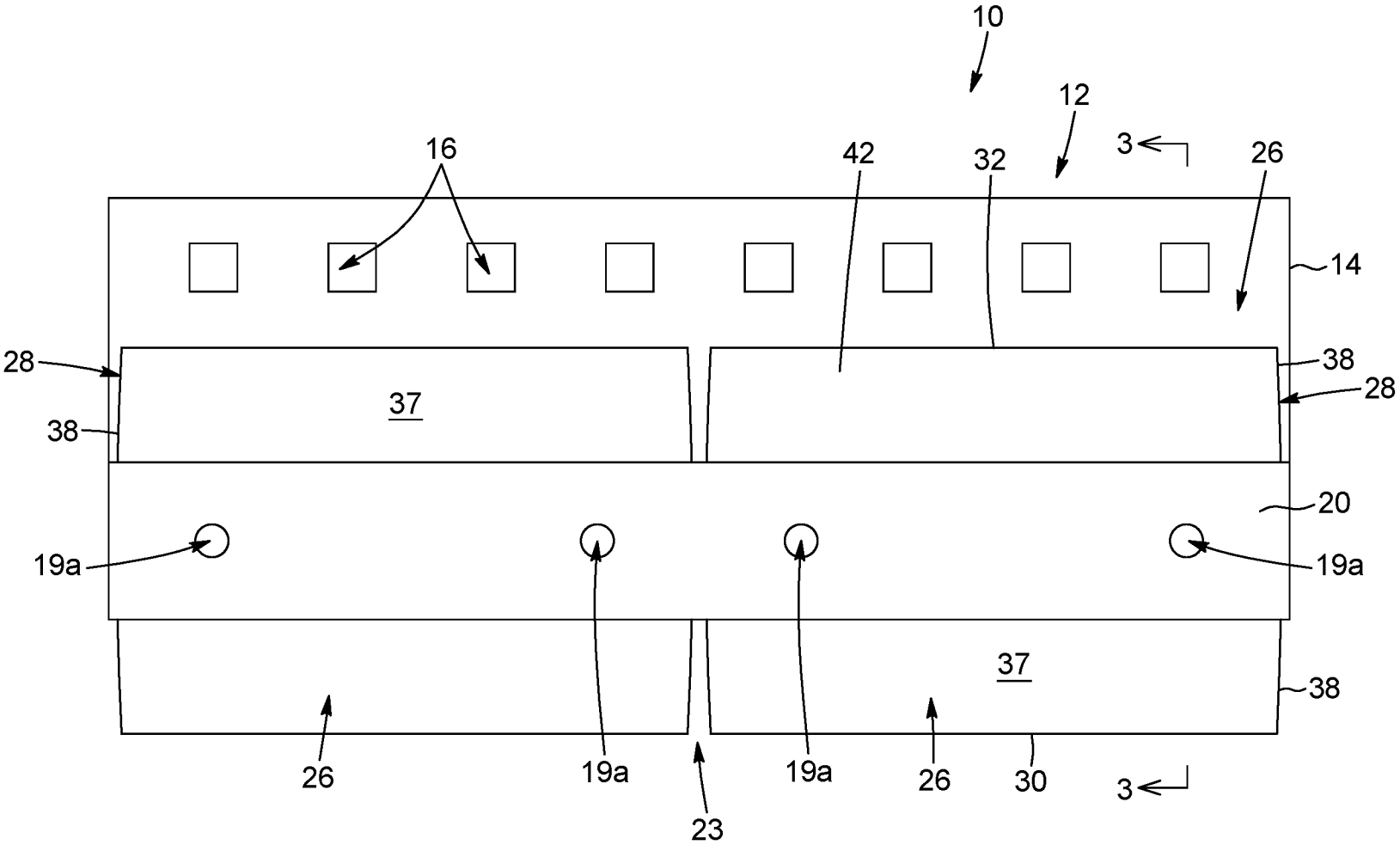
FIG. 2 is a front elevation view of the sweeping blade assembly of FIG. 1.

Referring now to the drawings and more particularly to FIGS. 1 and 2, there is shown a sweeping blade assembly 10 in accordance with a non-limitative embodiment, which is configured to be attached to a vehicle (not shown) for sweeping a ground surface. The sweeping blade assembly 10 can be attached to a plow blade (not shown) of a snowplowing vehicle, in a lower portion thereof, as will be described in more details below.

Still referring to the non-limitative embodiment of FIGS. 1 and 2, the sweeping blade assembly 10 includes a blade support 12 which an upper portion thereof is superposable and securable to the plow blade of the vehicle, and a plurality of sweeping blade devices 26, which in turn are secured to the blade support 12. Therefore, the sweeping blade devices 26 are indirectly mounted to the plow blade of the vehicle through the blade support 12. In the non-limitative embodiment shown in FIGS. 1 and 2, the sweeping blade assembly 10 comprises two sweeping blade devices 26 mounted to the blade support 12 and configured in an adjacent configuration. However, it is appreciated that, in an alternative embodiment, each one of the sweeping blade assemblies 10 can comprise only one sweeping blade device or more than two sweeping blade devices 26.

As mentioned above, it is noted that in one scenario, the sweeping blade devices 26 can be detachably securable to the blade support 12 using mechanical fasteners as will be described in more details below. The sweeping blade devices 26 are configured so as to travel over the ground surface, such as a road, a landing runway of an airport, a runway, a parking lot or the like, for removing snow, ice, debris or the like. The configuration of the multiple longitudinally-adjacent sweeping blade devices 26 helps in efficiently clearing snow and ice debris, even in harsh conditions, as it will be described in more details below. In one implementation, the sweeping blade devices 26 can also be secured to a blade support 12 in a way to work substantially independently (i.e., to move relative to the blade support 12 substantially independently from one another), for sweeping uneven ground surfaces more efficiently, for example (not shown). In the context of the present description, substantially independently with respect to the relative movement of the adjacent sweeping blade devices 26 is intended to mean that they can be independently mounted to the blade support 12.

Figure 3:
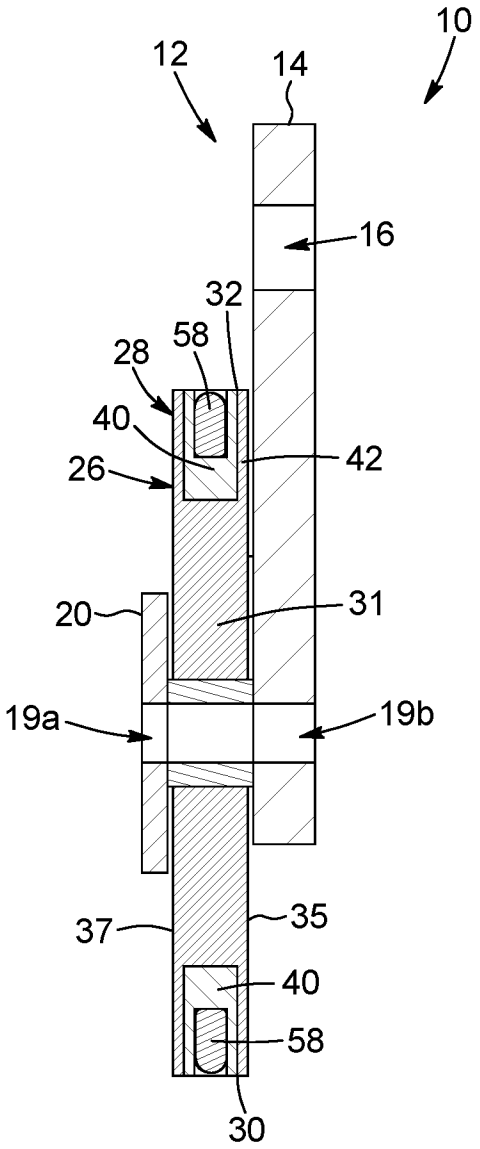
FIG. 3 is a cross-sectional view taken along section lines 3-3 of the sweeping blade assembly of FIG. 2.
Figure 4:
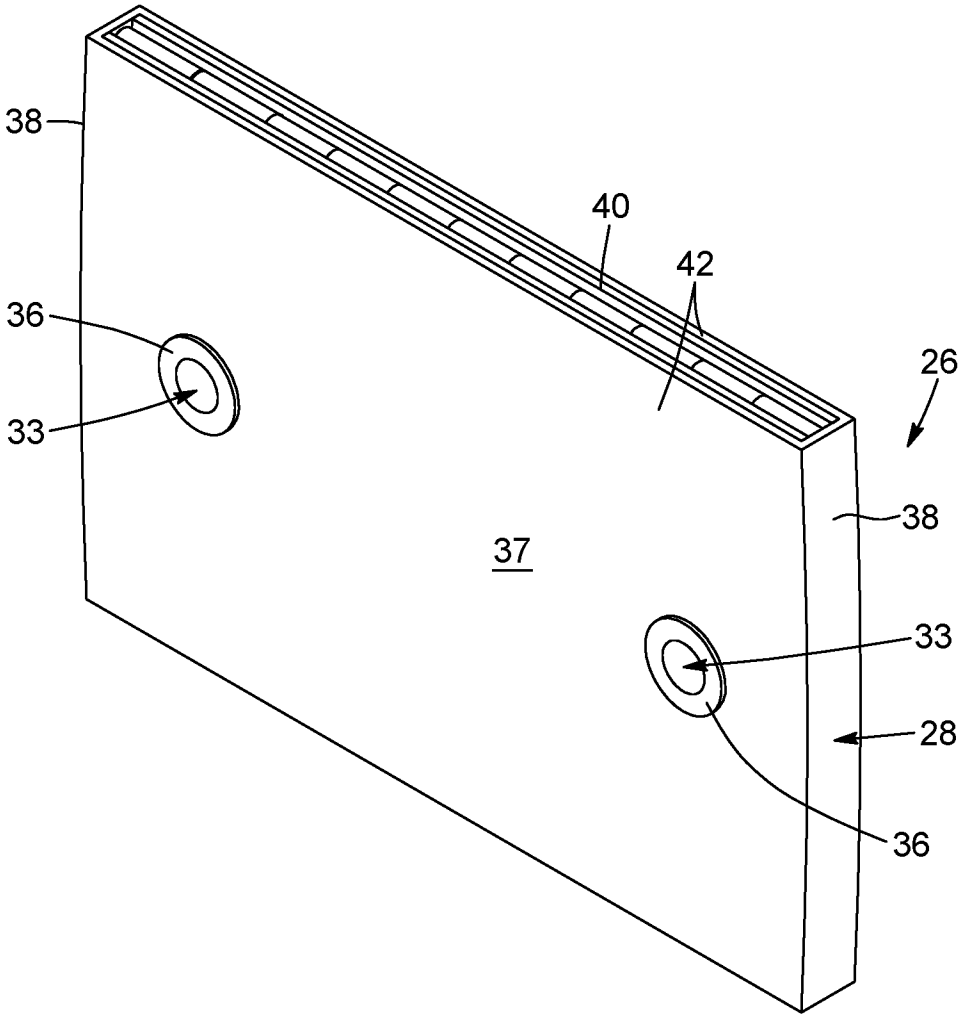
FIG. 4 is a top and front perspective view of one of the sweeping blades of the sweeping blade assembly of FIG. 1.
Figure 5:
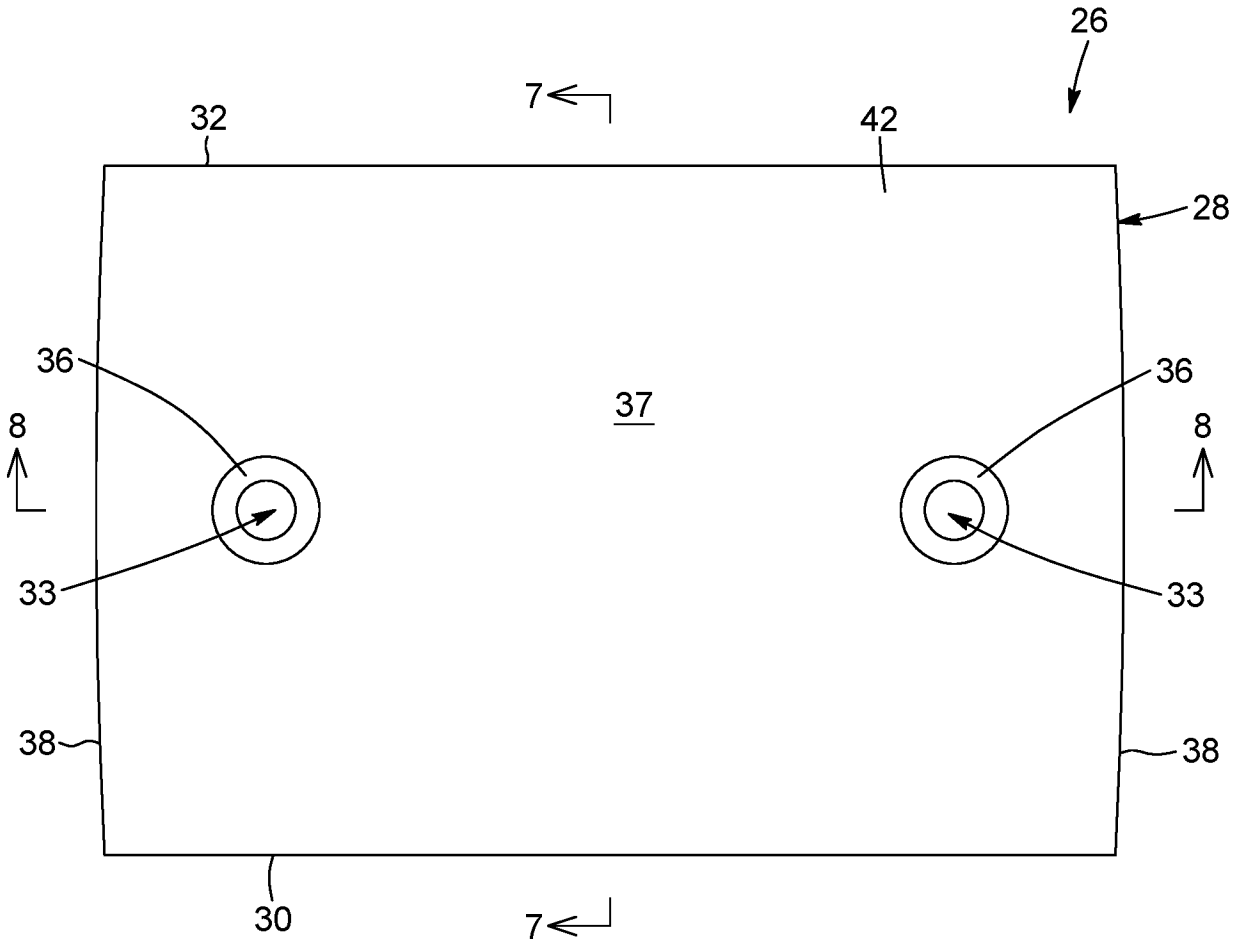
FIG. 5 is a front elevation view of the sweeping blade of FIG. 3.

Referring now more particularly to the non-limitative embodiment of FIGS. 1 to 3, the blade support 12 comprises a vehicle mounting portion or first plate 14 and a sweeping blade mounting portion or second plate 20, which is spaced-apart from the vehicle mounting portion 14 in a manner such that the sweeping blade devices 26 can be located (sandwiched) inbetween. The blade support 12 includes a plurality of spaced-apart apertures 16 which extend through the vehicle mounting portion 14, in an upper portion thereof, and which are spaced-apart from one another along a length L of the blade support 12. The apertures 16 allow universal attachment of the blade support 12 to the vehicle, such as to the plow blade of the vehicle, using a plurality of suitable mechanical fasteners (not shown) insertable therein, for example. Thanks to the plurality of spaced-apart apertures 16, the blade support 12 is configured so as to fit substantially any vehicle or plow blade. A plurality of mechanical fasteners (not shown), spaced-apart along the length L of the sweeping blade assembly 10, can be used to mount the blade support 12 to the vehicle. In the non-limitative embodiment shown, the length L of the sweeping blade assembly 10 substantially corresponds to the length of the blade support 12.

The blade support 12 further includes sweeping-blade mounting apertures 19*a*, 19*b* (FIGS. 1 to 3) which extend through the sweeping blade mounting portion 20 and the vehicle mounting portion 14 respectively and which are spaced-apart from one another along the length L thereof. The sweeping-blade mounting apertures 19*a*, 19*b* are provided in pairs with a first aperture 19*a* extending through the sweeping blade mounting portion 20 and a second aperture 19*b* extending through the vehicle mounting portion 14. In the vehicle mounting portion 14, the sweeping-blade mounting apertures 19*b* are located below the plurality of spaced-apart apertures 16 and are hidden by the sweeping blade devices 26, as shown in FIGS. 1 to 3. As will be described in more details below, in a non-limitative embodiment, each one of the sweeping blade devices 26 is mounted to the vehicle mounting portion 14 through two pairs of sweeping-blade mounting apertures 19*a*, 19*b*. Thus, the blade support 12 includes two pairs of sweeping-blade mounting apertures 19*a*, 19*b* for each sweeping blade device 26. When superposed, the sweeping-blade mounting apertures 19*a*, 19*b* of each pair are in register. It is appreciated that the number of pairs of sweeping-blade mounting apertures 19*a*, 19*b* for each sweeping blade device 26 can differ from the embodiment shown.

Now referring more particularly to the non-limitative embodiment of FIGS. 1 to 8, each sweeping blade device 26 comprises a blade main portion 28 and two bushing assemblies 31. The blade main portion 28 extends between a scraping edge or lower edge 30 (or a sweeping edge), which is adapted to contact with the ground surface, and a blade upper edge 32, which is found opposite to the scraping edge 30. The blade main portion 28 also defines a front or debris-contacting surface 37 and a rear surface or trailing surface 35, which is found opposite to the front surface 37.

Adjacent blade main portions 28 are separated by a gap 23 to allow rotation and translation of the blade main portion 28. More particularly, the gap 23 is dimensioned to allow sufficient angular and translational (horizontal and/or up/down) movement, as permitted by the bushing assemblies 31, as will be described in more details below.

Referring now to FIGS. 4 to 8, in the non-limitative embodiment shown, each one of the blade main portions 28 comprises a rigid blade 40 at least partially coated by a resilient material layer 42.

The blade main portion 28 further includes two blade-support mounting apertures 33 which extend therethrough between the front surface 37 and the rear surface 35. The blade-support mounting apertures 33 are spaced-apart from one another along the length L of the blade main portion 28. In the non-limitative embodiment shown, the blade-support mounting apertures 33 are located substantially centrally of a height of the blade main portion 28. However, it is appreciated that, in an alternative embodiment (not shown), they could be located in an upper half of the blade main portion 28. As will be described in more details below, the blade-support mounting apertures 33 allow attachment of the sweeping blade devices 26 to the blade support 12, using suitable mechanical fasteners (not shown) insertable therein, for example.

It is appreciated that, in an alternative embodiment (not shown), the blade main portion 28 can include a single blade-support mounting aperture 33, which could be located centrally therein along a length L of the blade main portion 28. Therefore, the sweeping blade assembly 10 would comprise only one bushing assembly 31 for each sweeping blade device 26 and each one of the sweeping blade devices 26 would mounted to the vehicle mounting portion 14 through a single pair of sweeping-blade mounting apertures 19*a*, 19*b*.

As mentioned above, the sweeping blade device 26 further comprises two resilient bushing assemblies 31, one for each blade-support mounting aperture 33. The sweeping blade 40 comprises two bushing holes 50 (FIG. 6) extending therethrough, spaced-apart along the length L of the sweeping blade 40. In the non-limitative embodiment shown, the bushing holes 50 are located substantially centrally of a height of the sweeping blade 40. However, it is appreciated that, in an alternative embodiment (not shown), they could be located in an upper half of the sweeping blade 40. In the non-limitative embodiment shown, the bushing holes 50 have a substantially rectangular cross-section, with rounded corners, but it is appreciated that it can be characterized by a different shape (oval, circular, elliptic, square, etc).

More particularly, each one of the resilient bushing assemblies 31 is received in a corresponding one of the bushing holes 50. Since both bushing holes 50 are substantially identical, only one will be described in the paragraphs below. A diameter of the bushing hole 50 is wider than a diameter of the mechanical fastener (not shown) used to connect the blade main portion 28 to the blade support 12. The resilient bushing assembly 31 comprises a resilient bushing 34 at least partially filing an internal space in the bushing hole 50 and defined between a periphery of the bushing hole 50 and the mechanical fastener (not shown) received therein. In the non-limitative embodiment shown, the resilient bushing assembly 31 further comprises a rigid sleeve 36, such as rigid polymeric or a metal-based sleeve, received in an aperture defined in the resilient bushing 34. The rigid sleeve 36 defines the blade-support mounting aperture 33, which extends therethrough and is designed to receive the mechanical fastener (or sweeping blade fastener).

The rigid sleeve 36 prevents direct contact between the resilient bushing 34 and the mechanical fastener. More particularly, the resilient bushing 34 can be configured to surround the rigid sleeve 36. The rigid sleeve 36 is used to operatively and detacheably/removeably secure the blade main portion 28 to the blade support 12, whereby as the blade main portion 28 vibrates and moves at an attack angle and angularly in response to road obstacles, these vibrations and shocks are absorbed and/or dampened by the resilient bushing 34 which is provided between the metal portion of the blade main portion 28, i.e. the sweeping blade 40, and the rigid sleeve 36 to avoid any metal to metal contact. A metal to metal contact (for instance, without the resilient bushing 34) results in an increase in wear and repair due to vibration which causes costs increase to the user of such a blade for removing snow from all kinds of roads and surfaces.

In the non-limitative embodiment shown, the rigid sleeve 36 is centrally mounted with respect to the bushing hole 50. However, in an alternative embodiment (not shown), it can be mounted eccentric with respect to the bushing hole 50, for instance and without being limitative, in an upper portion thereof.

In an embodiment, one or more airgaps (not shown) can be provided within the resilient bushing 34 for improving the compressibility thereof. This arrangement allows for increased movement flexibility of the blade main portion 28, wherein, when the resilient bushing 34 is compressed, the blade main portion 28 may move upward to avoid the obstacle and reduce its impact on the entire sweeping blade assembly 10. Whereas when the obstacle happens to be closer to one lateral edges 29 of the blade main portion 28 than the other, the bushing assemblies 31 allow to the blade main portion 28 to move angularly and rotate to one side (or to tilt) to reduce the impact of the obstacle onto the sweeping blade assembly 10.

In the embodiment shown, each one of the sweeping blade devices 26 comprises two bushing assemblies 31, spaced-apart from one another along the length L of the sweeping blade devices 26. However, in an alternative embodiment (not shown), each one of the sweeping blade devices 26 can comprise a single bushing assembly 31, which can be centrally mounted along the length L thereof. In still another alternative embodiment (not shown), each one of the sweeping blade devices 26 can comprise more than two bushing assemblies 31.

The blade-support mounting apertures 33 and the sweeping-blade mounting apertures 19*a*, 19*b* have a circumference sufficient to allow a respective sweeping blade fastener (not shown) to pass therethrough. Furthermore, when assembled together, corresponding blade-support mounting apertures 33 and sweeping-blade mounting apertures 19*a*, 19*b* are aligned or in registered in a manner such that a respective one of the sweeping blade fasteners can be inserted therein. Each sweeping blade fastener is of a sufficient length such that a distal end thereof can pass through the sweeping-blade mounting apertures 19*b* that extends through the vehicle mounting portion 14 of the blade support 12, through a corresponding blade-support mounting aperture 33 which extends through the blade main portion 28 of one of the sweeping blade devices 26, and through a corresponding sweeping-blade mounting aperture 19*a* which extends through the sweeping blade mounting portion 20 of the blade support 12, such that a nut (not shown), for example, can be threaded onto the distal end of the sweeping blade fastener. When the distal ends of the sweeping blade fasteners are passed through the mounting apertures 19*a*, 19*b*, 33, and nuts (not shown) are fastened thereto, the sweeping blade devices 26 can be held securely between the vehicle mounting portion 14 and the sweeping blade mounting portion 20 of the blade support 12 with the lower or scraping edge 30 of each sweeping blade device 26 extending downwardly from the blade support 12, i.e. from the vehicle mounting portion 14 and the sweeping blade mounting portion 20, and can be positioned for scraping the surface, a road covered with snow, ice or other debris, for example. A person skilled in the art to which the present sweeping blade assembly 10 pertains would however understand that other attachment means could be used to secure the sweeping blade devices 26 to a blade support 12. For example, the sweeping blade devices 26 can also be detachably engageable with a corresponding blade support, as mentioned above. In an embodiment, the sweeping blade assembly 10 can be free of sweeping blade mounting portion 20.

The resilient bushing 34 and the resilient material layer 42, if any, are at least partially made of a resilient material. The expression "resilient material" is intended to mean a material which absorbs energy when it is deformed elastically and then, when the force causing the deformation is removed, unloads this energy by substantially taking back its initial shape. Examples include, without limitations, natural rubber, polymeric material, a wide range of composite material and the like. The expression "rubber material" is intended to mean a material in which bond lengths deviate from the equilibrium (minimum energy) and strain energy is stored electrostatically. Examples include, without limitations, compositions of nitrile, hydrogenated nitrile, ethylene-propylene, fluorocarbon, chloroprene, silicone, fluorosilicone, polyacrylate, ethylene acrylic, styrene-butadiene, polyurethane, rubber material and the like.

In a non-limitative embodiment, the resilient bushing 34 and the resilient material layer 42 are integral forming a single continuous unit.

In the non-limitative embodiment shown, the resilient material layer 42 covers the sweeping blade 40 along its entire height H, from the lower edge 30 to the upper edge 32. However, in an alternative embodiment, the resilient material layer 42 could cover only a portion thereof and, in still another alternative embodiment, the blade main portion 28 could be free of resilient material layer.

The resilient bushing 34 being compressible, they allow for limited free movement of the blade main portion 28 with respect to the blade support 12. More particularly, the blade main portions 28 can translate/slide between the vehicle mounting portion (or first plate) 14 and the sweeping blade mounting portion (or second plate) 20. They can slide substantially linearly with the lower or scraping edge 30 remaining substantially parallel to longitudinal edges of the vehicle mounting portion 14 and the sweeping blade mounting portion 20 or in an angular manner wherein the blade main portion 28 tilts or pivots. When displaced in an angular manner, the lower or scraping edge 30 of the blade main portion 28 defines an oblique angle with the longitudinal edges of the vehicle mounting portion 14 and the sweeping blade mounting portion 20.

The blade support 12 and the rigid blade 40 of the sweeping blade devices 26 can be made of a hard, durable material. Each sweeping blade device 26 can therefore be made from a variety of materials depending on the application of the sweeping blade assembly 10. For example, the sweeping blade devices 26 can be made from steel, cast iron, and the like. As shown in FIGS. 3, 4, 6, and 7, the sweeping blade devices 26 can be provided with a plurality of blade inserts 58 or a hard facing (not shown) along the scraping edges 30 thereof. Indeed, in one scenario, each sweeping blade device 26 can include a downwardly-opened longitudinal insert-receiving channel which can be configured for receiving the plurality of blade inserts (hard-material blade inserts), such as and without being limitative, carbide inserts. On the other hand, the blade inserts 58 or hard facing can be made of various durable materials known to the person skilled in the art, for example, carbide, ceramic, etc.

In the embodiment shown, each one of the sweeping blade device 26 comprises a first blade insert, made of carbide, inserted in an insert-receiving channel located at a first edge of the sweeping blade 40, for instance the lower edge 30 in the figures, and a second blade insert, made of carbide, inserted in an insert-receiving channel located at a second edge of the sweeping blade 40, opposed to the first edge, for instance the upper edge 32 in the figures. The sweeping blade devices 26 being removably attachable to the blade support 12, they are therefore reversible to sweep the ground with the second scraping edge when the first scraping edge is worn out, i.e. the sweeping blade device 26 can be mounted upside down and the other sweeping edge, still unused, can be used instead, thereby substantially doubling the life time of the sweeping blade device 26.

As mention above, depending on the location of the obstacle hit by the blade main portion 28 with respect to its lower or scraping edge 30, the blade main portion 28 will experience a linear displacement or an angular displacement. As the properties of the material of the resilient bushing 34 and the diameter of the bushing hole 50, amongst others, limits the linear displacement of blade main portion 28 with respect to the blade support 12, the angular displacement is limited by the relative position of adjacent sweeping blade devices 26, i.e. the gap 23 defined between adjacent sweeping blade devices 26. For the purpose of this description, the tilting angle corresponds to the angle defined between the lower or scraping edge 30 of the blade main portion 28 and the longitudinal edges of the vehicle mounting portion 14 and the sweeping blade mounting portion 20 (or the ground surface or an horizontally-extending axis).

In an embodiment, the blade support 12 has at least two of the sweeping blade devices 26 mounted thereto with the gap 23 between the lateral edges 38 of adjacent ones of the sweeping blade devices 26 ranging between about 0.2 inch and about 0.3 inch at the lower scraping edge 30 of the blade main portion 28 and, in a particular embodiment is around 0.25 inch±15%.

In the non-limitative embodiment shown, the blade main portions 28 includes substantially parallel lower and upper edges 30, 32 connected together by two spaced-apart curved lateral edges 38. More particularly, the lateral edges 38 are curved outwardly, i.e. a convex curvature, to provide clearance and allow increased angular displacement of the blade main portion 28 when an obstacle on the road surface is hit. In the embodiment shown, the curvature of the lateral edges 38 is smooth and regular. However, it is appreciated that, in an alternative embodiment, the curvature of the lateral edges 38 can increase going towards either the lower edge 30 or the upper edge 32.

Figure 6:
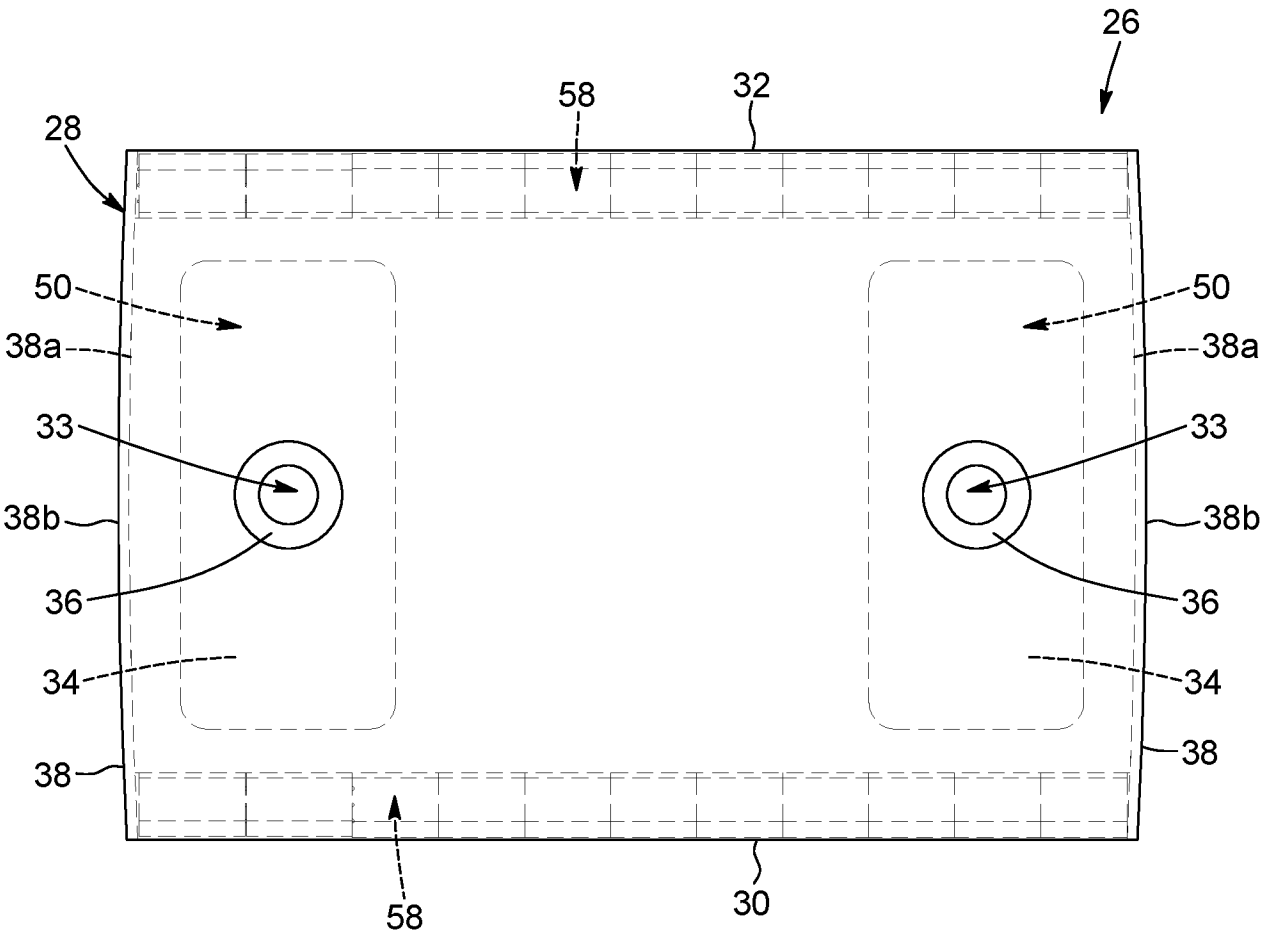
FIG. 6 is a front elevation view of the sweeping blade of FIG. 3, showing internal details.
Figure 7:
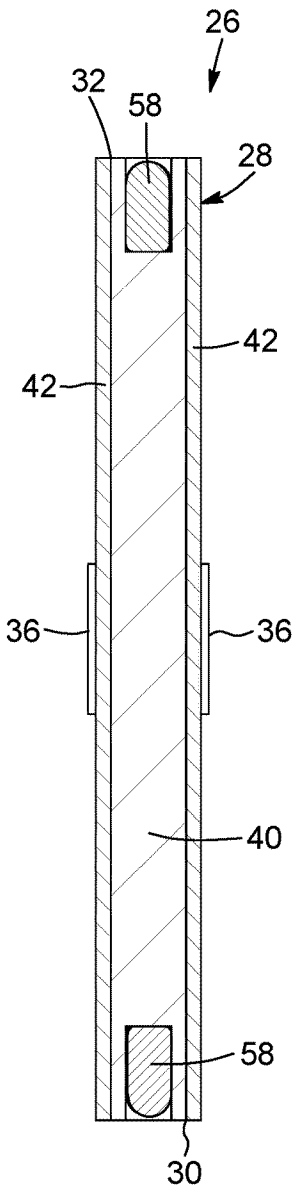
FIG. 7 is a sectional view taken along section lines 6-6 of the sweeping blade of FIG. 5.
Figure 8:
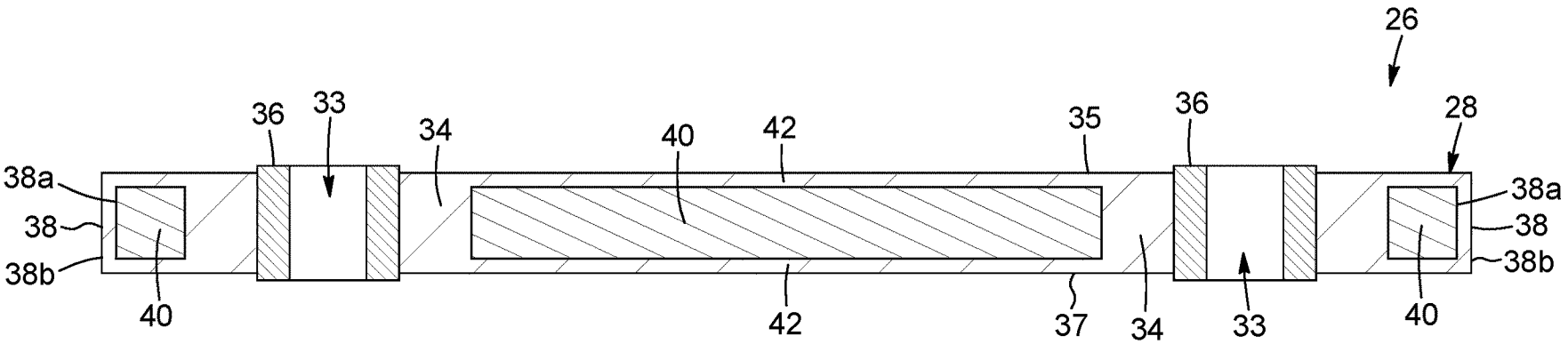
FIG. 8 is a sectional view taken along section lines 7-7 of the sweeping blade of FIG. 5.

In the embodiment shown, referring to FIGS. 6 and 8, the lateral edges 38*a* of the sweeping blade 40 are curved. The resilient material layer 42 covering the surfaces of the sweeping blade 40, except the lower and upper edges 30, 32, wherein the blade inserts are exposed at least at the scraping edge, follows the shape of the sweeping blade 40 and its lateral edges 38*b* are also curved.

In an embodiment, the radius of curvature of the lateral edges 38, 38*a*, 38*b* can range between about 50 and about 110 inches for a sweeping blade device having a length L ranging between about 1 foot and, in an embodiment, the radius of curvature of the lateral edges 38, 38*a*, 38*b* can range between about 70 and about 90 inches.

The curvature in the lateral edges 38 increases the clearance between two adjacent sweeping blade devices 26 and thereby increasing the possible angular displacement before the adjacent sweeping blade devices 26 abut and further angular displacement is prevented. Thereby, blade main portions 28 characterized by a greater curvature in the lateral edges 38 and/or having a greater gap 23 inbetween, are allowed to a greater tilting angle. On the contrary, to limit the allowed tilting angle, the gap 23 between adjacent sweeping blade devices 26 and/or the curvature in the lateral edges 38 of the blade main portions 28 can be reduced.

Figure 9:
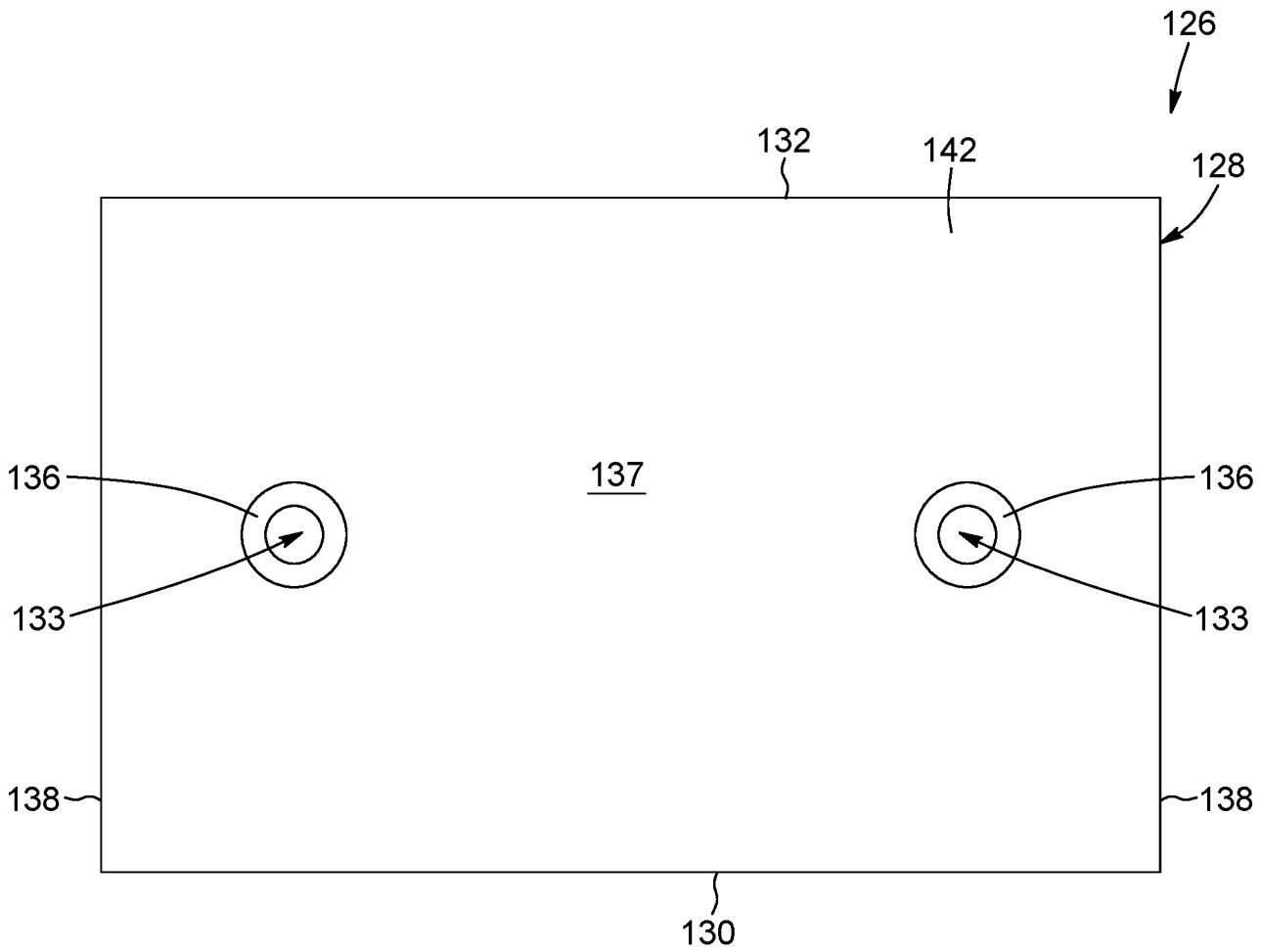
FIG. 9 is a front elevation view of the sweeping blade in accordance with another non-limitative embodiment, wherein an overall outer profile of the sweeping blade is substantially rectangular.
Figure 10:
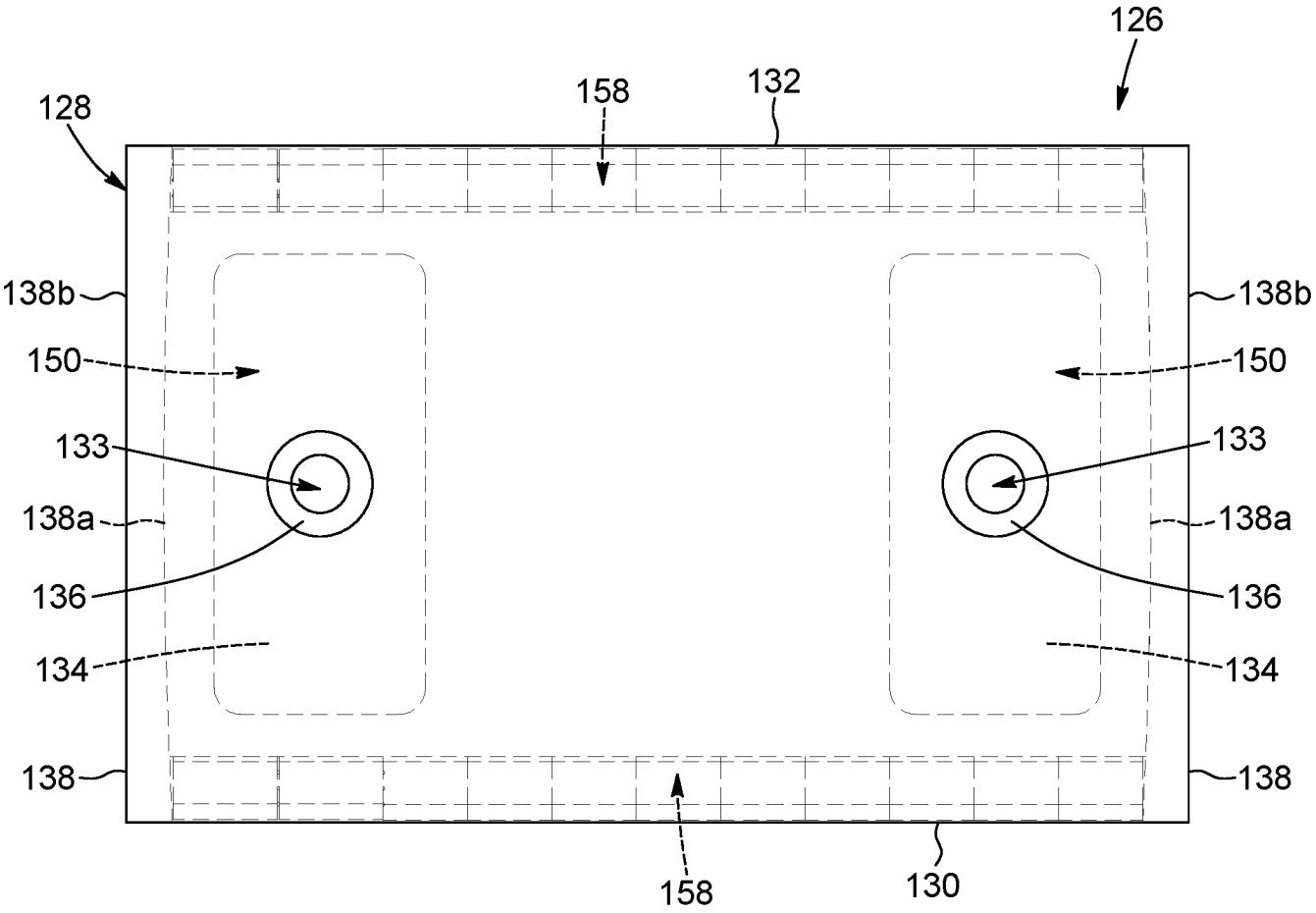
FIG. 10 is a front elevation view of the sweeping blade of FIG. 9, showing internal details.

Referring now to FIGS. 9 and 10, there is shown an alternative embodiment of the sweeping blade assembly 10, wherein the features are numbered with reference numerals in the 100 series which correspond to the reference numerals of the previous embodiment.

The features of the embodiment shown in FIGS. 9 and 10 are substantially identical to the one described above in reference to FIGS. 1 to 8. However, the shape of the resilient material layer 142 covering the sweeping blade 140 along its entire height H is different. In the embodiment shown in FIGS. 1 to 8, the shape of resilient material layer 42 is substantially similar to the shape of the sweeping blade 40 including the convex curvature in the lateral edges 38*b*, i.e. it substantially conforms thereto. In the embodiment shown in FIGS. 9 and 10, the resilient material layer 142 exhibits substantially straight lateral edges 138*b*, extending substantially parallel to one another. Therefore, the sweeping main blade 128 has a substantially rectangular outer profile.

Since the resilient material layer 142 is deformable, the substantially straight lateral edges 138*b*, i.e. the additional resilient material adjacent to the upper and lower edges 132, 130, does not entirely prevents the angular displacement of the sweeping blade devices 126 when an obstacle is hit but decelerates the rotation movement when two adjacent sweeping blade devices 126 come into contact upon hitting an obstacle and being engaged in rotation.

Figure 11:
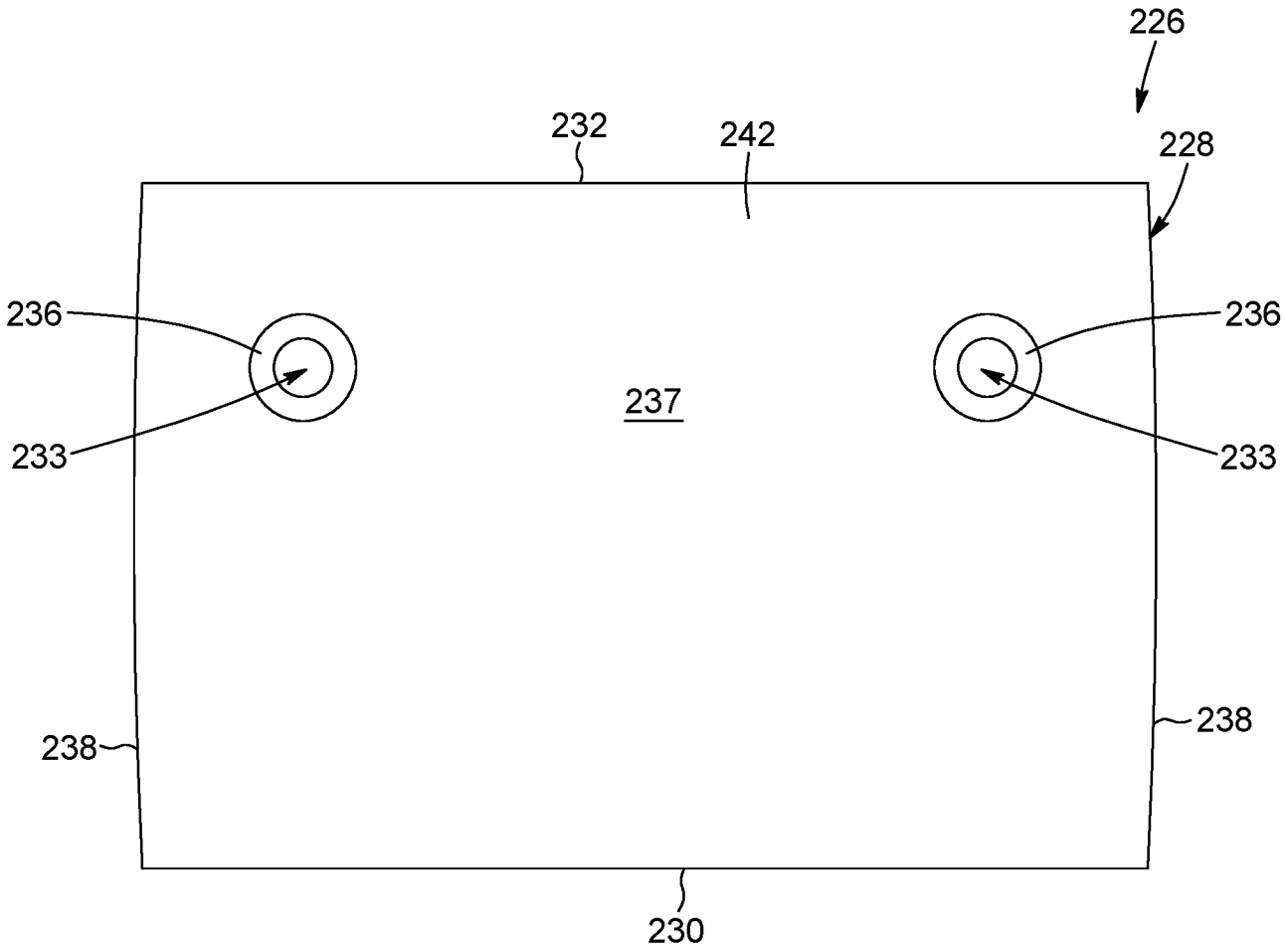
FIG. 11 is a front elevation view of the sweeping blade in accordance with another non-limitative embodiment, wherein the sweeping blade includes only one scraping edge.
Figure 12:
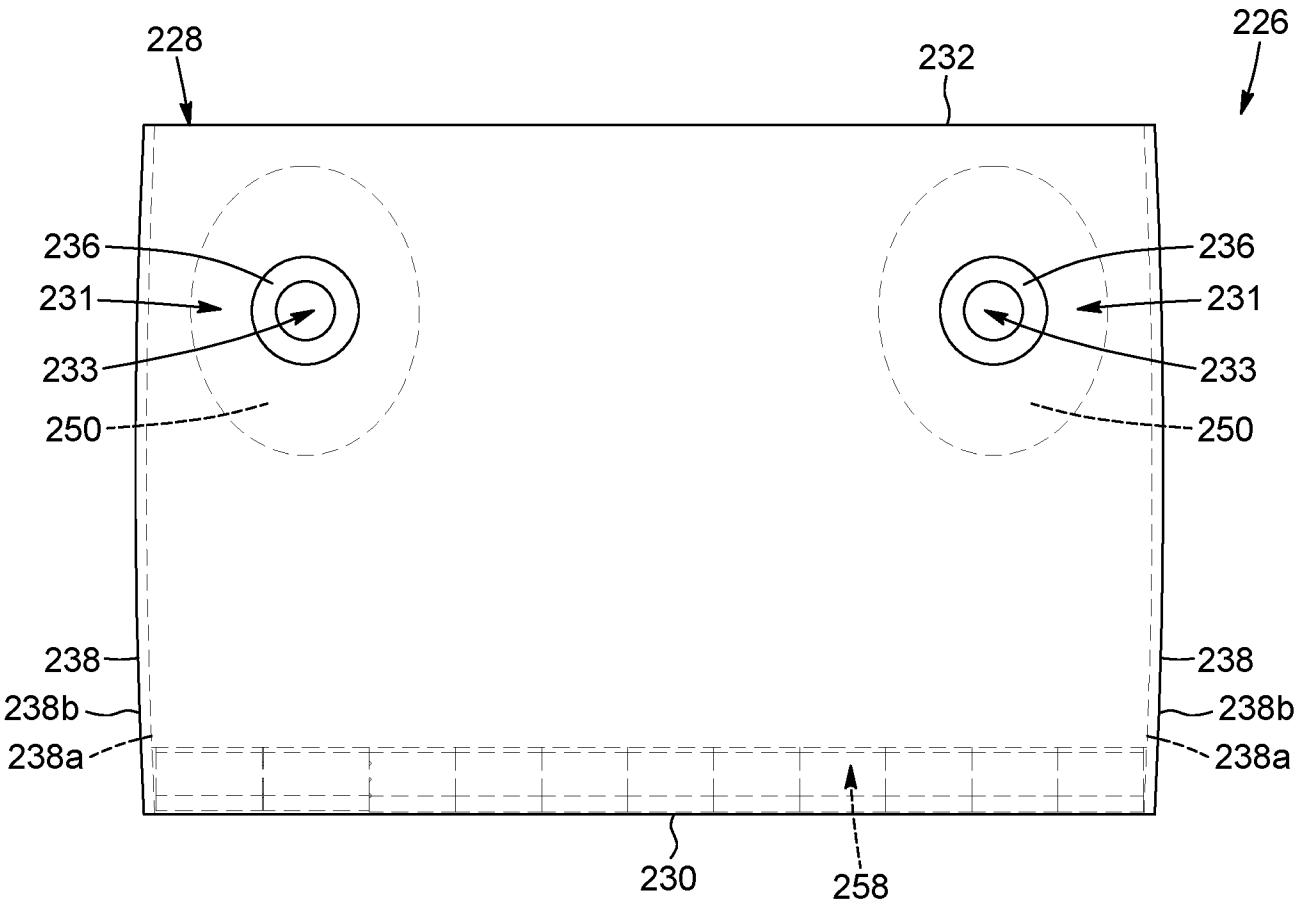
FIG. 12 is a front elevation view of the sweeping blade of FIG. 12, showing internal details.

Referring now to FIGS. 11 and 12, there is shown an alternative embodiment of the sweeping blade assembly 10, 110, wherein the features are numbered with reference numerals in the 200 series which correspond to the reference numerals of the previous embodiment.

The features of the embodiment shown in FIGS. 11 and 12 are substantially identical to the one described above in reference to FIGS. 1 to 8 and FIGS. 9 and 10. However, the sweeping blade device 226 includes a single row of inserts 258, located at the lower edge 230. Therefore, the main blade portion 228 is not reversible. It is appreciated that the resilient material layer 242 exhibits convexly curved lateral edges 238*b*, as the embodiment shown in FIGS. 1 to 8, but it could include substantially straight lateral edges, extending substantially parallel to one another, as the embodiment shown in FIGS. 9 and 10.

In the embodiment shown in FIGS. 11 and 12, the main blade portion 228 comprises two spaced-apart bushing assemblies 231 wherein the blade-support mounting apertures 233 are located in an upper portion of the main blade portion 228 and are substantially elliptical in shape. Once again, it is appreciated that the shape and the configuration of the bushing assemblies 231 can vary from the embodiment shown.

Figure 13:
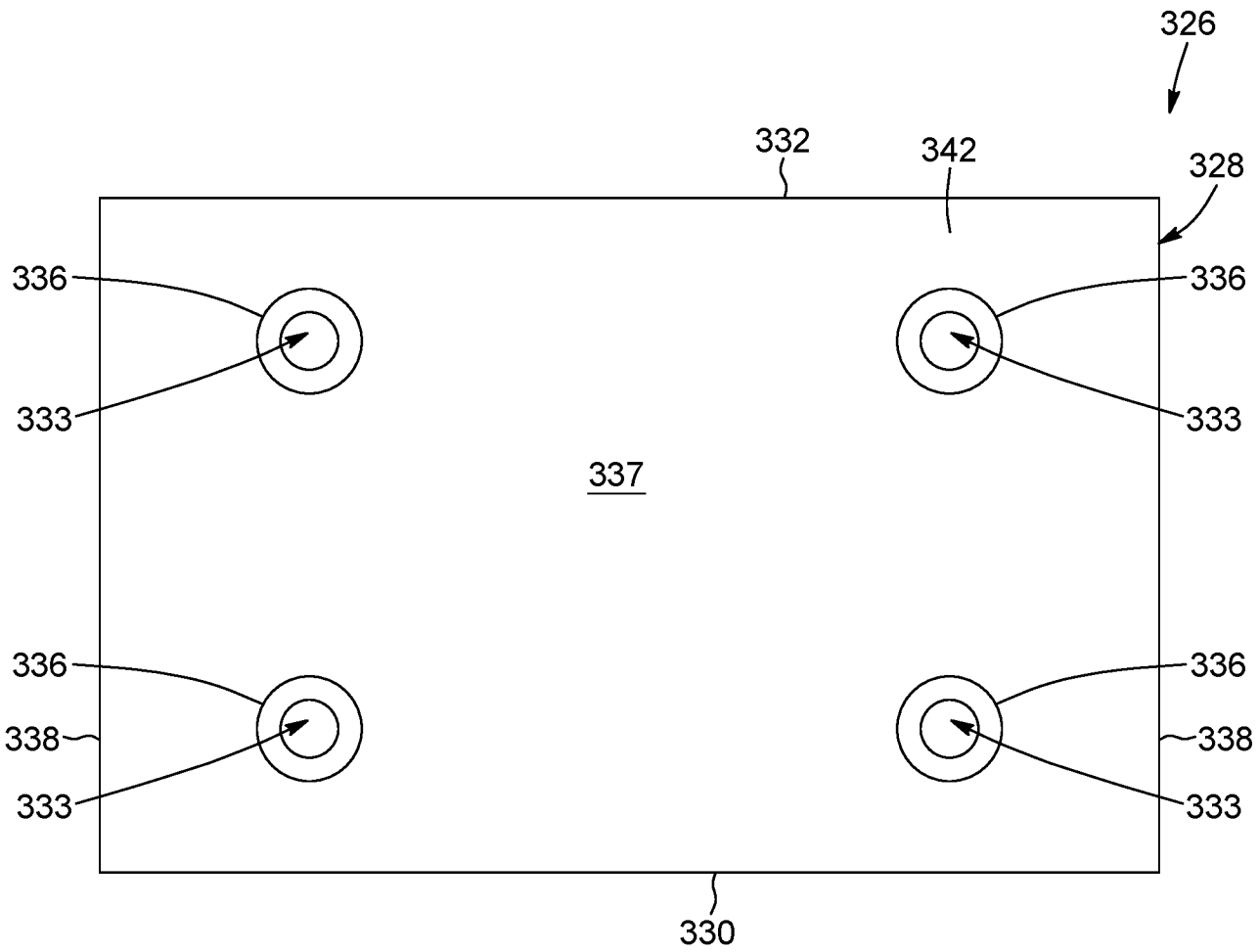
FIG. 13 is a front elevation view of the sweeping blade in accordance with another non-limitative embodiment, wherein the sweeping blade includes two pairs of superposed resilient bushing assemblies.
Figure 14:
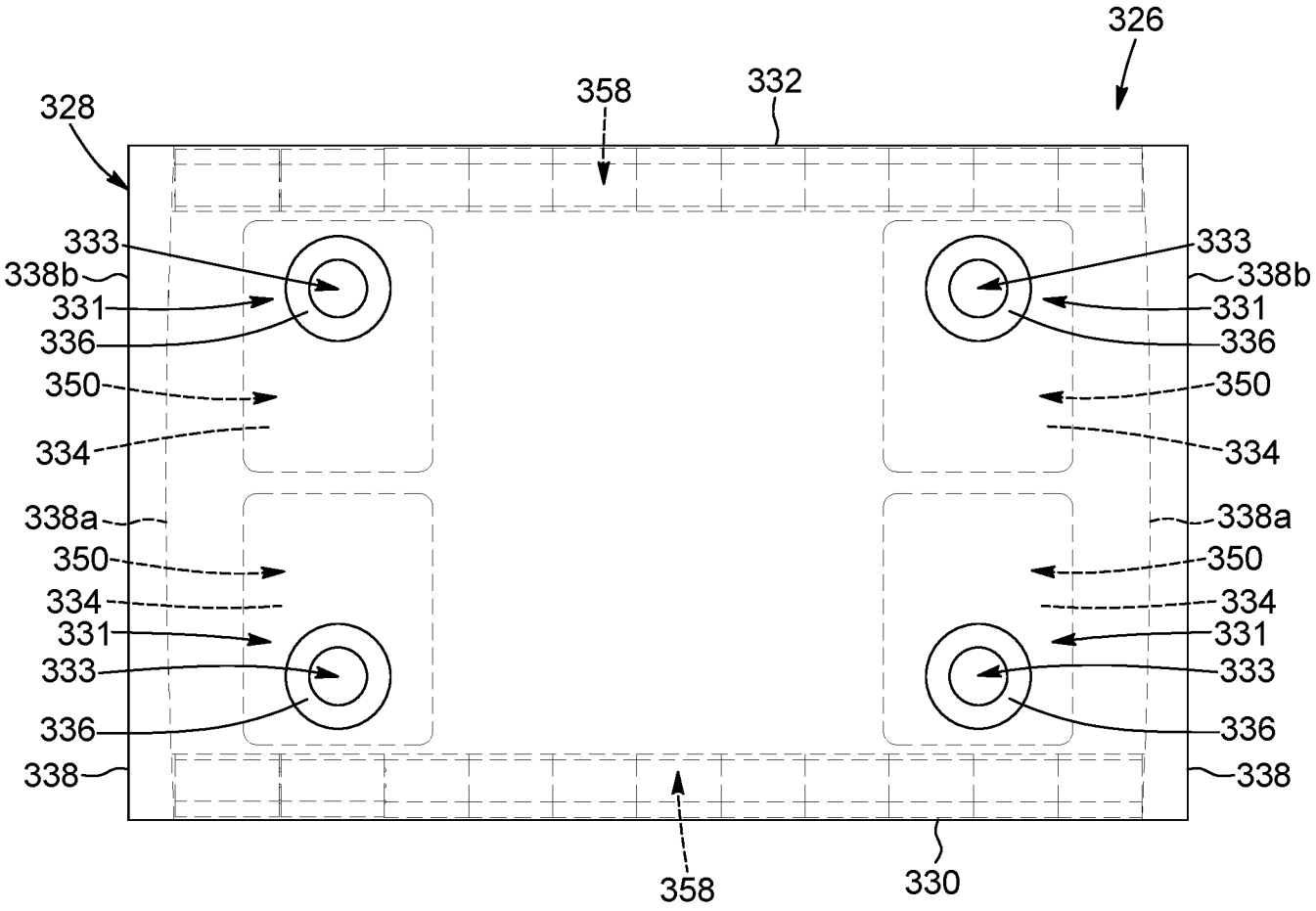
FIG. 14 is a front elevation view of the sweeping blade of FIG. 13, showing internal details.

Referring now to FIGS. 13 and 14, there is shown an alternative embodiment of the sweeping blade assembly 100, wherein the features are numbered with reference numerals in the 300 series which correspond to the reference numerals of the previous embodiment.

The features of the embodiment shown in FIGS. 13 and 14 are substantially identical to the one described above in reference to FIGS. 9 to 10. However, the sweeping blade device 326 includes two pairs of resilient bushing assemblies 331, respectively located in an upper portion and a lower portion of the the main blade portion 328. Thereby, when the sweeping blade device 326 is reversed to expose the second row of inserts 358 to the road surface, the sweeping blade device 326 is mounted to the blade support 12 using a second one of the resilient bushing assemblies 331.

In the non-limitative embodiment shown, the blade-support mounting apertures 333 and the associated rigid sleeves 36 are not centered in their respective bushing holes 350 but are located closer to their respective row of inserts 358.

The bushing holes 350 and resilient bushing 334 have a substantially rectangular cross-section, with rounded corners, but it is appreciated that it can be characterized by a different shape (oval, circular, elliptic, square, etc).

Once again, the resilient material layer 342 exhibits convexly curved lateral edges 338*b*, as the embodiment shown in FIGS. 1 to 8, but it could include substantially straight lateral edges, extending substantially parallel to one another, as the embodiment shown in FIGS. 9 and 10.

The other features of the sweeping blade assembly 10 can be embodied in the embodiments of FIGS. 9 and 10, FIGS. 11 and 12, and FIGS. 13 and 14, such as and without being limitative the blade support 12, the mechanical fasteners, and the like.

It can also be appreciated by a person skilled in the art to which the sweeping blade assembly 10, 110, 210, 310 pertains that vehicles other than snowplowing vehicles can be equipped with the above-described blade support 12. It is also noted that the blade support 12 can be comprised of one elongated blade support 12, as shown in FIGS. 1 to 3, or can be comprised of multiple blade supports mounted to the vehicle in an adjacent configuration (not shown).

The blade support 12 can be secured to a front, rear or side of a snowplowing vehicle or snowplowing apparatus. The blade support 12 can be secured to the front, rear or side of the vehicle using the plurality of suitable mechanical fasteners (not shown) insertable in at least some of the spaced-apart apertures 16, for example, which are then inserted into corresponding apertures (e.g., threaded apertures) provided on the front, rear or side of the vehicle or apparatus (not shown).

The sweeping blade fastener (not shown) can be shaped such that a head of the mechanical fastener can sit beneath a surface defined by the vehicle mounting portion 14 once it has been inserted through a respective mounting apertures 19*a*. While the blade support 12 can be releasably secured to the vehicle using suitable mechanical fasteners, such as bolts and locknuts, it can be appreciated by the person skilled in the art that various other attachment methods can be used, including studs, press fit studs, rivets or adhesive, for example. The blade support 12 can even be permanently attached to the vehicle or apparatus by, for example, welding, tack welding or other methods. It is noted that the blade support 12 can be of varying lengths and heights. For example, the blade support 12 can be between about 36 and 60 inches in length.

The sweeping blade devices 26, 126, 226, 326 can be of varying lengths and heights. For example, the sweeping blade devices 26, 126, 226, 326 can be between about 4 and 12 inches in height. On the other hand, the sweeping blade devices 26 can be between about 6 inches and 24 inches in length.

As best shown in FIGS. 1 to 3, once the sweeping blade devices 26, 126, 226, 326 are securely held in place between the vehicle mounting portion 14 and the sweeping blade mounting portion 20 of the blade support 12, lower portions 27 of the sweeping blade devices 26, 126, 226 extend outwardly (i.e., downwardly) past the blade support 12. The lower portions 27 of the sweeping blade devices 26, 126, 226, 326 are therefore exposed.

In some implementations, the blade support 12 (i.e., the vehicle mounting portion 14 and the sweeping blade mounting portion 20), the plurality of reinforced sweeping blade devices 26, 126 226, 326 and/or the plurality of sweeping blade fasteners can be secured one to another by preventing metal to metal contact between the components/parts of the sweeping blade assembly. The ability to have absolutely no metal to metal contact (or to reduce the metal to metal contact) can significantly reduce the vibration throughout the whole sweeping blade assembly 10, 110, 210, 310 and can result in more complete and efficient snow removal by way of example only. It can also reduce overall operating costs. Another benefit of using the resilient layer 42, 142, 242, 342 is that, as the resilient layer deforms, it can allow the reinforced sweeping blade devices 26, 126, 226, 326 to move slightly in response to uneven surfaces, obstructions or debris, while not placing undue stress on the blade support 12 of the sweeping blade assembly 10, 110, 210, 310.

In the above description, an embodiment is an example or implementation of the inventions. The various appearances of "one embodiment," "an embodiment" or "some embodiments" do not necessarily all refer to the same embodiments. Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

Although various features of the invention may be described in the context of a single embodiment, the features may also be provided separately or in any suitable combination. Conversely, although the invention may be described herein in the context of separate embodiments for clarity, the invention may also be implemented in a single embodiment.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element. It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A sweeping blade assembly configured to be attached to a plow blade of a vehicle for sweeping debris on a ground surface, the sweeping blade assembly comprising:

a blade support securable to the vehicle; and a plurality of sweeping blade devices mounted to the blade support in an adjacent and spaced-apart configuration, each one of the sweeping blade devices comprising: a blade main portion comprising a rigid sweeping blade having a lower scraping edge, an upper edge, and opposed lateral edges convexly curved between the upper edge and the lower scraping edge, the rigid sweeping blade being pivotally mounted to the blade support with its lower scraping edge being configured to contact the ground surface.

2. The sweeping blade assembly of claim 1, wherein the blade main portion further comprises a resilient material layer covering at least partially the rigid sweeping blade including the convexly curved lateral edges of the rigid sweeping blade, the blade main portion having convexly and curved lateral edges formed by the resilient material layer covering the convexly curved lateral edges of the rigid sweeping blade.

3. The sweeping blade assembly of claim 1, wherein the blade main portion further comprises a resilient material layer covering at least partially the rigid sweeping blade including the convexly curved lateral edges of the rigid sweeping blade, the blade main portion having substantially straight lateral edges formed by the resilient material layer covering the convexly curved lateral edges of the rigid sweeping blade, the substantially straight lateral edges of the blade main portion extending substantially parallel to one another.

4. The sweeping blade assembly of claim 1, wherein the upper edge of the rigid sweeping blade is spaced-apart from the lower scraping edge and extends substantially parallel to the lower scraping edge.

5. The sweeping blade assembly of claim 4, wherein the sweeping blade device further comprises blade inserts contained in the rigid sweeping blade at the lower scraping edge and the upper edge of the rigid sweeping blade.

6. The sweeping blade assembly of claim 5, wherein the blade inserts are exposed outwardly at the lower scraping edge.

7. The sweeping blade assembly of claim 1, wherein the convexly curved lateral edges of the rigid sweeping blade have a radius of curvature ranging between about 70 inches and about 90 inches.

8. The sweeping blade assembly of claim 1, wherein the blade support has at least two of the sweeping blade devices mounted thereto with a gap defined between adjacent ones of the sweeping blade devices, the gap ranging between about 0.2 inch and about 0.3 inch at the lower scraping edge of the blade main portion.

9. A vehicle comprising a sweeping blade assembly of claim 1.

10. The sweeping blade assembly of claim 1, wherein the rigid sweeping blade is wider along the lateral edges than at the upper edge and at the lower scraping edge.

11. A sweeping blade device comprising:

a blade main portion including a rigid sweeping blade and blade inserts, the rigid sweeping blade having a lower scraping edge, an upper edge, spaced-apart from the lower scraping edge and extending substantially parallel thereto, and convexly curved and opposed lateral edges extending between the lower scraping edge and the upper edge, wherein the blade inserts are contained in the rigid sweeping blade at the lower scraping edge and the upper edge.

12. The sweeping blade device of claim 11, wherein the blade main portion further comprises a resilient material layer covering at least partially the rigid sweeping blade including the convexly curved lateral edges of the rigid sweeping blade, the blade main portion having convexly curved lateral edges formed by the resilient material layer covering the convexly curved lateral edges of the rigid sweeping blade.

13. The sweeping blade device of claim 11, wherein the blade main portion further comprises a resilient material layer covering at least partially the rigid sweeping blade including the convexly curved lateral edges of the rigid sweeping blade, the blade main portion having substantially straight lateral edges formed by the resilient material layer covering the convexly curved lateral edges of the rigid sweeping blade, the substantially straight lateral edges of the blade main portion extending substantially parallel to one another.

14. The sweeping blade device of claim 11, wherein the blade inserts are exposed outwardly at the lower scraping edge.

15. The sweeping blade device of claim 11, wherein the convexly curved lateral edges of the rigid sweeping blade have a radius of curvature ranging between about 70 inches and about 90 inches.

16. The sweeping blade device of claim 11, wherein the rigid sweeping blade is wider along the lateral edges than at the upper edge and at the lower scraping edge.

* * * * *